United States Patent [19]

Jones

[11] 4,425,170

[45] Jan. 10, 1984

[54] DESENSITIZING EXPLOSIVES

[75] Inventor: Walter T. Jones, Orpington, England

[73] Assignee: The Secretary of State for Defence in Her Britannic Majesty's Government of the United Kingdom of Great Britain and Northern Ireland, London, England

[21] Appl. No.: 173,395

[22] Filed: Jul. 29, 1980

Related U.S. Application Data

[63] Continuation of Ser. No. 903,794, May 8, 1979, abandoned.

[30] Foreign Application Priority Data

May 11, 1977 [GB] United Kingdom ..... 19869/77

[51] Int. Cl.[3] ..... C06B 45/22

[52] U.S. Cl. ..... 149/109.6; 149/11; 149/92; 149/93; 264/3 C; 427/212

[58] Field of Search ..... 264/3 C; 149/7, 11, 149/18, 19.1, 109.6, 92, 93

[56] References Cited

U.S. PATENT DOCUMENTS

| | | | |
|---|---|---|---|
| 2,719,153 | 9/1955 | Schulz | 149/11 |
| 2,867,647 | 1/1959 | Gow et al. | 149/11 |
| 3,348,986 | 10/1967 | Sauer | 149/11 |
| 3,403,061 | 9/1968 | McDonald | 149/11 |
| 3,455,749 | 7/1969 | gow | 149/11 |
| 3,544,360 | 12/1970 | Gow | 149/11 |
| 3,740,278 | 6/1973 | Sakreis et al. | 149/11 |
| 4,092,187 | 5/1978 | Hildebrant | 149/11 |
| 4,097,317 | 6/1978 | Schnur | 149/7 |

FOREIGN PATENT DOCUMENTS 574271 12/1945 United Kingdom .

*Primary Examiner*—Edward A. Miller

*Attorney, Agent, or Firm*—Stevens, Davis, Miller & Mosher

[57] ABSTRACT

Sensitive explosive materials such as RDX or HMX may be desensitized by stirring them up with micronised wax in a liquid medium, usually water. The wax is in the form of particles having a mean size of less than 20 microns, preferably less than 6 microns, and particularly preferred is a wax having a mean particle size of from 2 to 4 microns and a specific surface area of from 15000 to 30000 $cm^2/cm^3$. Wax in this form adheres to the explosive material and even as little as 1% of wax produces significant desensitization. The invention provides a method by which, in particular, waxes of high melting and softening points which cannot be melted onto the explosives material by conventional methods, can be applied to sensitive explosives materials and thereby provide effective desensitization even at relatively high temperatures.

15 Claims, No Drawings

DESENSITIZING EXPLOSIVES

This application is a continuation of application Ser. No. 903,794, filed May 8, 1978 and now abandoned.

The present invention relates to a method of preparing a desensitized explosives composition by treatment of an explosives material with a wax, particularly a high-melting wax, by which is meant herein a wax with a melting point in excess of 100° C.

Explosives materials have heretofore been treated with waxes having melting points below 100° C. by adding the wax to about 3 parts of water containing about 1 part of the explosives material and heating to a temperature of about 98°–99° C. to melt the wax.

The molten wax is distributed on the surface of the explosives material crystals and a granular mass is formed which can be filtered off and dried. This type of product is not very effectively desensitized since the wax is only loosely attached to the explosives crystals and does not cover the entire surface of each crystal.

Furthermore this process is not applicable to the coating of explosives with high melting waxes.

In copending application Ser. No. 173,396, a continuation of Ser. No. 903,838, now abandoned, there is described a method for the preparation of a desensitized explosives material using a wax which melts or softens at a temperature which is less than the safe decomposition temperature of the explosive. This method involves adding to a treatment vessel, with stirring, the wax and a paste of an explosives material in a liquid medium which is effective to desensitize the explosives material but which is not a solvent therefor; heating this mixture under continued stirring until the liquid medium has evaporated off from the surfaces of the explosives material and the wax has at least softened and has become coated onto said surfaces, and finally cooling the mixture under stirring. The product is a wax-encapsulated explosives material which is desensitized compared to the untreated explosives material and which is therefore safer to handle and to press into charges. Again, however, according to this method, it is not possible to treat the explosive with a wax which softens only above or even in the region of the safe decomposition temperature of the explosives material being coated. In fact according to conventional practice in manufacturing plants concerned with the preparation of such explosives mixtures, it is not generally acceptable to heat explosives materials to a temperature which approaches at all closely the safe decomposition temperature of the explosive and in such cases the process of the present invention is particularly applicable. For example with RDX although its safe decomposition temperature is around 180° C., it has not normally heretofore been the practice to heat RDX above about 115° C. In order to desensitize RDX with a wax having a higher softening point than this therefore, the present process which does not necessarily involve heating the wax/explosives material mixture is to be considered as likely to be preferred by those concerned with the manufacture of such materials.

The present process provides a method of desensitizing an explosive material using a wax, and is particularly useful where the wax has high softening and melting points which may be in the region of, or even above, the safe decomposition temperature of the explosives material. The product obtained using such a wax can, unlike those obtained with lower melting waxes, be subjected to relatively high temperature without suffering a loss of desensitization due to loss of the wax by its melting, provided, of course that the explosives material itself remains stable and RDX for example is relatively stable even at a temperature as high as 180° C.

By the 'safe decomposition temperature' is meant the upper temperature limit to which a given explosives material may be subjected without the occurrence of unacceptable decomposition of the explosives material or unacceptable danger of sudden decomposition occurring. Such temperatures are well understood in relation to any given explosive by those skilled in the art.

The process of this invention can also be used with low-melting waxes and has a general advantage over the process of the copending application Ser. No. 173,396 in that it requires no input of heat and can generally be carried out in the cold.

According to the present invention, a process for the preparation of a desensitized explosives composition comprises the steps of:

(a) forming a paste of an explosives material in a liquid medium which is a non-solvent for the explosives material and for the wax;

(b) adding to said paste, with stirring, a wax having a mean particle size of less than 20 microns, and a wetting agent; and (c) filtering off the treated explosives material.

The method may further optionally include a step of drying the explosives material, depending on whether or not the desensitized explosives material is to be used further in dry or wet form. If the wax has a sufficiently low softening point, it is possible either during or after the drying step by continued heating and stirring, to coat the wax onto the surfaces of the explosives material to provide a fully wax-encapsulated material.

The invention also provides a desensitized explosives material wherein the material has attached to its surfaces, particles of a wax having a mean particle size of less than 20 microns.

Surprisingly it has been found that following this procedure, the particles of the explosives material become covered with a 'dusting' of the finely divided wax particles and this dusting provides the necessary desensitization. The wax used according to the present invention preferably has a mean particle size of less than 6 microns. Whilst the wax particles are ideally as small as possible, in practical terms it has been found relatively easy to manufacture a wax having a specific surface area in the range of from 15,000 to 30,000 $cm^2/cc$ which corresponds to a mean particle size in the range of 2 to 4 $\mu$ and such a wax has been found to give satisfactory results for the process of this invention. It will be appreciated that since it is the mean particle size which is defined for this invention, some of the particles used may have sizes which are larger than the limiting mean size, for example some of the wax may be present in particles up to 70 $\mu$ in size or even larger, and such occurrence of larger particles is not in any way deleterious to the process or product of this invention.

The explosives materials which may be treated according to the process of the present invention include any of the conventional particulate explosives such as cyclotrimelhylene trinitramine (RDX), cyclotetramethylene tetranitramine (HMX), pentaerythritol tetranitrate (PETN), diaminotrinitrobenzene (DATNB) and nitroguanidine. (Picrite)

The liquid medium chosen will be a 'non-solvent' for the explosives material to be treated and for the wax to be used and in most cases water will be a suitable, and is the preferred, liquid medium. Other liquids which may be used, when circumstances are appropriate, include trichlorethylene and carbon tetrachloride.

Any type of wax may be used including mixtures of different waxes and there is no particular limit on the amount of wax which may be used though it is preferred to have as little as possible present consistent with achieving a satisfactory degree of desensitization of the explosives material. As little as 1% of wax, based on the total weight of the composition, can be used while obtaining useful desensitization. 'Useful desensitization' of an explosives material as understood in the art depends on the purposes for which the material is to be used. For example, in the case of RDX, use as a shell filling preferably demands that the explosives material should have a Figure of Insensitiveness value in excess of 120 (compared with a value for production RDX of 73) but for other uses which involve less handling and no tamping of the charge, an F of I value of 90 might be quite satisfactory. The situation is also complicated by the fact that the friction sensitiveness of the explosive may also be a significant factor in determining the useful level of desensitization in any given case.

As the wetting agent, any of the conventional surfactants such as fatty acid esters, e.g. the Tween materials, or sulphate esters, e.g. Teepol L, may be used. Only a small amount in the range of 0.05 to 0.20% by weight of the dry explosives material is required; preferably about 0.1% of the wetting agent is used.

According to another aspect of the invention, the desensitized explosives composition may further include other conventional additives. For example aluminium powder may conveniently be added to the wax-treated explosives material after drying in amounts of up to 30% or more by weight of the total composition, typically 15 to 30%. The aluminium powder adheres to the wax dusting on the surface of the explosives material and to the explosives material itself. Blown rather than flake aluminium is preferred for these compositions, and the powder preferably has a sieve analysis of 125 microns to dust.

In carrying out the process of the present invention, the explosives material is added to the liquid medium in a suitable vessel, e.g. in an incorporator vessel, provided with a stirrer. The explosives/liquid medium mixture should be a rich one, i.e. in the form of a paste containing from 15 to 50% by weight of the explosive material, preferably about 25% by weight. To the stirred explosives/liquid medium paste the wetting agent is added, followed by a finely-divided wax. The whole composition is then stirred for a sufficient period to fully distribute the wax among the explosives material during which operation the particles of the explosives material become covered with a 'dusting' of wax particles. A period of stirring of about 30 minutes at ambient temperature is generally satisfactory for a 50 Kg batch of material, and the stirring period should be increased approximately pro rata for larger batches. The treated explosives material, still in paste form, may then be passed through a suitable filter and the solid material separated and dried, either on an open tray or in a steam incorporator, or alternatively, if the stirring vessel is an incorporator, after coating the wax onto the explosives material in the paste, steam heat may be applied directly to the incorporator to drive off the liquid medium in the paste and leave the solid explosives/wax composition in the vessel. This material is then allowed to cool and is offloaded from the vessel. If it is desirable not to heat the composition in order to drive off the liquid medium which is present, this can instead be removed by the application of vacuum to the wet mixture. Alternatively at this stage and where the wax is one which will soften or even melt, heating may be applied to cause the wax to smear over the surfaces of the explosives material.

If aluminium powder is to be incorporated into the desensitized explosives composition, this is added after drying and cooling the composition. The aluminium may either be added directly into the incorporator vessel if this is used, or alternatively, the dried and cooled explosives/wax composition and the aluminium powder can be introduced into a tumbler and mixed thoroughly.

The invention is further illustrated by way of reference now made to the following Examples of the practice thereof.

Example 1: Preparation of an RDX-Wax composition 5.59 Kg of wet Grade 1B RDX (Defence Standard 07-23/Issue 1)having a measured water content of 15% by weight (equivalent to 0.84Kg of water) is placed in a Werner-Pfliederer type horizontal bladed incorporator, and 0.75 Kg of water added to bring the total water content to 25% by weight. Thereafter 0.10% of Teepol L (4.75g) are added, the mixture stirred for 10 minutes to blend, and then 250 grams of finely-divided Wax 3 (diacid amido of p-phenylene diamine and stearic acid; m.p. 160°–170° C.; Defence specification CS2675A) added over a period of 5 minutes. The wax has a specific surface area of 15000 to 30000 $cm^2/cc$ (corresponding to a mean particle size range of from 4 $\mu$ to 2 $\mu$).

After all the wax has been added, stirring is continued for 30 minutes at ambient temperature, and then the incorporator is steam heated for one hour, vacuum being applied for the last 15 minutes and the temperature rising to 95° C. At the end of this drying period the steam is turned off and the incorporator allowed to cool to ambient temperature before the desensitized explosives composition is off-loaded. When tested by the Rotter test, the desensitized composition had an F of I of 110.

Example 2: Preparation of an Aluminium-containing RDX-Wax composition 3.50 Kg of the desensitized composition prepared as in Example 1, was placed in a cylindrical tumbler and 1.50 Kg of aluminium powder (Defence specification CS5350; mean particle size 50 $\mu$) added. The tumbler was then rotated at about 30 rpm for 30 minutes to thoroughly mix the two powders. The product, containing 30% by weight of aluminium, was found to have an F of I of 100.

The effectiveness of the desensitizing process of this invention may be appreciated from the following data, showing F of I values for various compositions of wax with RDX, produced both by prior art methods and by the process of this invention. The values were determined by the Rotter test as median values from 50 caps.

F of I values for desensitized RDX compositions

| Weight of RDX % | Wax Type | Wax Weight % | Method of wax-coating | Weight of Al powder (%) | F of I value |
|---|---|---|---|---|---|
| 100 | None | — | — | None | 80[1] |
| 100 | None | — | — | None | 73[2] |

-continued

F of I values for desensitized RDX compositions

| Weight of RDX % | Wax Type | Wax Weight % | Method of wax-coating | Weight of Al powder (%) | F of I value |
|---|---|---|---|---|---|
| 88 | Wax 8[4] | 12 | Conventional | None | 110 |
| 91 | Wax 8[4] | 9 | Conventional | None | 90 |
| 93 | Wax 8[4] | 7 | Conventional | None | 94 |
| 95 | Wax 8[4] | 5 | Conventional | None | 96 |
| 61.6 | Wax 8[4] | 8.4 | Conventional | 30[3] | 104 |
| 90 | Wax 3 | 10 | Invention ("dusted") | None | 140 |
| 95 | Wax 3 | 5 | Invention ("dusted") | None | 110 |
| 95 | Wax 3 | 5 | Invention ("dusted") | None | 104 |
| 99 | Wax 3 | 1 | Invention ("dusted") | None | 90 |
| 66.5 | Wax 3 | 3.5 | Invention ("dusted") | 30 | 100 |
| 66.5 | Wax 3 | 3.5 | Invention ("dusted") | 30[3] | 99 |

[1]standard value for purified RDX
[2]production quality RDX
[3]aluminium incorporated into dried wax/RDX mixture when cold
[4]Wax 8 is a composition of 15% low density polythene (eg Alkathene 20 by ICI Ltd) with 85% of a microcrystalline hydrocarbon wax obtained from the still bottoms of crude petroleum distillation and freed from oil by solvent extraction (Wax 6). Wax 6 has a congealing point of 80–86° C. while the polythene has a softening point of 112° C.

A particularly useful product is one in which the wax used is a mixture of equal parts of Wax 3 and Wax 6. This mixture softens at 90°–95° C. and can be smeared onto an explosives material by heating, to this temperature, a product abtained by "dusting" the wax onto the explosives material. The wax has a melting point of 165° C. and so provides effective desensitization even at high temperatures.

I claim:

1. A process for the preparation of a desensitized explosive by treatment of a particulate explosive with a wax comprising the steps of:

(a) forming a paste of a particulate explosive in a liquid medium that is a non-solvent for the explosive and for said wax, (b) adding to said paste, with stirring, said wax in a particulate form with a mean particle size of less than 20 microns, and a wetting agent selected from the group consisting of fatty acid esters and sodium alkyl sulphates of higher fatty alcohols to form a treated explosive, and (c) filtering off said treated explosive, wherein each of steps (a), (b) and (c) is performed in the cold and further wherein the amount of wetting agent added is about 0.05% to about 0.2% (by wt) of the dry explosive.

2. The process of claim 1 wherein said wax has a mean particle size of less than 6 microns.

3. The process of claim 1 wherein said wax has a mean particle size of 2 to 4 microns and a specific surface area in the range of from about 15,000 to about 30,000 $cm^2/cm^3$.

4. The process of claim 1 wherein said liquid medium is an aqueous medium.

5. The process of claim 1 wherein said paste contains from about 15 to 50% by weight of the explosive.

6. The process according to claim 5 wherein said paste contains 25% by weight of the explosive.

7. The process of claim 1 wherein said wax comprises from about 1 to about 10% by weight of the desensitized explosive.

8. The process of claim 1 wherein said wetting agent comprises from about 0.05 to about 0.20% by weight of the dry explosive.

9. The process of claim 1 wherein said wetting agent comprises about 0.1% by weight of the dry explosive.

10. The process of claim 1 further comprising (d) drying the treated explosive.

11. The process of claim 10 further including (e) allowing the treated explosive to cool, and (f) mixing the cooled treated explosive with powdered aluminium.

12. The process of claim 11, wherein said aluminium comprises from about 15 to about 30% by weight of the total composition.

13. The process of claim 1 wherein the explosive is cyclotriethylene trinitramine, cyclotetramethylene tetranitramine, pentaerythritol tetranitrate, diaminotrinitrobenzene, or nitroguanidine.

14. The process of claim 1 wherein said wax has softening and melting points which are in the region of or above the safe decomposition temperature of the explosive.

15. A process for coating a particulate explosive with a wax to desensitize the explosive which comprises (a) stirring a paste containing from about 15% to about 50% by weight of said explosive and a wax having a mean particle size of less than 20 microns in a non-solvent for the explosive and the wax which contains a wetting agent selected from the group consisting of fatty acid esters and sodium alkyl sulphates of higher fatty alcohols until the explosive is coated with said wax, and (b) filtering the paste to recover the resulting wax-coated explosive, wherein each of steps (a) and (b) is performed in the cold and further wherein the amount of wetting agent added is about 0.05% to about 0.2% (by wt) of the dry explosive.

* * * * *